United States Patent [19]

Ikuta et al.

[11] Patent Number: 4,757,234

[45] Date of Patent: Jul. 12, 1988

[54] FLUORESCENT DISPLAY DEVICE

[75] Inventors: Youichi Ikuta; Hiroshi Watanabe; Kiyoshi Morimoto, all of Mobara, Japan

[73] Assignee: Futaba Denshi Kogyo Kabushiki Kaisha, Mobara, Japan

[21] Appl. No.: 45,246

[22] Filed: May 4, 1987

Related U.S. Application Data

[63] Continuation of Ser. No. 671,198, Nov. 14, 1984, abandoned.

[30] Foreign Application Priority Data

Nov. 26, 1983 [JP] Japan ..... 58-222714

[51] Int. Cl.[4] ..... H01J 63/06

[52] U.S. Cl. ..... 313/496; 313/112; 313/117

[58] Field of Search ..... 313/496, 510, 517, 519, 313/117, 497, 112, 466

[56] References Cited

U.S. PATENT DOCUMENTS

| | | | |
|---|---|---|---|
| 3,160,774 | 12/1964 | Guy | 313/466 |
| 4,455,774 | 6/1984 | Watanabe | 313/496 X |

FOREIGN PATENT DOCUMENTS

| | | | |
|---|---|---|---|
| 12259 | 1/1979 | Japan | 313/466 |
| 146575 | 11/1979 | Japan | 313/466 |
| 1306766 | 2/1973 | United Kingdom | 313/466 |

*Primary Examiner*—Palmer C. DeMeo

*Attorney, Agent, or Firm*—Oblon, Fisher, Spivak, McClelland & Maier

[57] ABSTRACT

A fluorescent display device which is capable of substantially reducing reflection by wiring conductors and anode conductors to significantly improve visibility in reading of a display segment. The fluorescent display device is constructed in a manner to arrange anode conductors and wiring conductors each formed of a metallic film through a colored antireflection film on a substrate.

7 Claims, 6 Drawing Sheets

FLUORESCENT DISPLAY DEVICE

This application is a continuation of application Ser. No. 671,198, filed on Nov. 14, 1984, now abandoned.

BACKGROUND OF THE INVENTION

1. Field of the Invention

This invention relates to a fluorescent display device, and more particularly to a fluorescent display device of the front emission type wherein luminous display is observed through one surface of a light-permeable insulating substrate which has a phosphor-coated anode conductor formed on the other surface thereof.

2. Description of the Prior Art

In a fluorescent display device of the front emission type, a wiring conductor and an anode conductor each are prepared in a manner to form a film of a conductive material on a substrate by a suitable means such as vacuum deposition, sputtering or the like and remove an unnecessary portion from the film by photolithography to form a predetermined pattern. Thus, the wiring conductor and anode conductor are typically formed of the same electrically conductive material.

A fluorescent display device is generally classified into a fluorescent display device wherein a conductive material is formed of a transparent conductive film such as an ITO (indium-tin-oxide) film, a tin oxide film or the like and a fluorescent display device wherein a conductive material comprises a metallic film and an anode conductor is formed into a mesh-like or pectinate shape to define gaps therein.

The present invention is generally directed to an improvement in an anode substrate for a fluorescent display device of the front emission type wherein a conductive material is formed of a metallic film.

One of conventional fluorescent display devices of the front emission type is illustrated in FIGS. 1 and 2 which employs a dynamic driving system. In the fluorescent display device shown in FIGS. 1 and 2, wiring conductors 104 are formed by forming a film of aluminum on a substrate 101 and remove an unnecessary portion from the film by etching utilizing photolithography to form slit sections 102 to divide the film every display segment group 103. Each of the wiring conductors 104 has corresponding display segments of the respective digits connected thereto. The segments each are provided thereon with a slit or mesh-like anode conductor 105, on which a phosphor layer 106 is deposited to cover at least an opening of each display segment. For exaple, in FIG. 1, the phosphor layer 106 is deposited to extend to the periphery of the opening as shown in dotted lines.

Another one of conventional fluorescent display devices of the front emission type is shown in FIG. 3 in which a static driving system is employed. In the fluorescent display device shown in FIG. 3, a control electrode is eliminated therefrom and an auxiliary electrode is substitutionally provided on the same plane as an anode so as to prevent charging at the periphery of the anode and uniformly accelerate electrons emitted from a cathode.

In the fluorescent display device of FIG. 3, the formation of wiring conductors is carried out by applying a film of aluminum onto a substrate 101 and removing an unnecessary portion of the film by etching utilizing photolithography to form slit sections 102, to thereby form fine wiring conductors 104 isolated from a metallic film 107 of the background and terminal connections 104a positioned at one end thereof. Each of segments 103 is formed at the outer periphery thereof with a frame 108 which is connected to the corresponding wiring conductor 104. A mesh-like anode conductor 105 arranged within the frame 108 is formed in the substantially same manner as in FIG. 1. A phosphor layer 106 is deposited on the anode conductor 105 to cover an opening P of each display segment and the frame 108 positioned at the periphery thereof as indicated in dotted lines in FIG. 3. However, even in this instance, it is merely required to deposit the phosphor layer 106 so as to cover at lesat the opening P of the display segment.

The fluorescent display device shown in FIG. 3, as described above, is constructed to isolate the metallic film 107 constituting the background from the anode conductors 104 and wiring conductors 105 so that potential constantly positive with respect to a cathode may be applied to the metallic film 107 to allow constantly positive electric field to be formed around the anode, to thereby effectively prevent any display defect.

When the anode substrate substantially covered with the film of aluminum as described above is viewed from the substrate side, the wiring conductors 104 and mesh-like anode conductors 105 formed of the aluminum film are observed as a specular surface through the substrate 101 as shown in FIG. 2. The specular surface causes external light to be reflected thereby at a specular reflection ratio of about 80% to hinder the reading of the display segments, to thereby decrease in visibility.

An attempted solution to such a problem as described above has been to provide a fluorescent display device which is shown in FIGS. 4 and 5 and adapted to reduce the area of a film pattern section, to thereby decrease the specular reflection. In the fluorescent display device of FIGS. 4 and 5, anode conductors 202 and wiring conductors 203 are formed by forming a film of aluminum on the overall surface of a substrate 201 by a suitable method such as vacuum deposition, sputtering or the like and then removing an unnecessary portion from the film by etching utilizing photolithography to leave the anode conductors 202 and wiring conductors 203. The anode conductors 202 each are constituted by a frame-like anode conductor 202*a* and a mesh-like anode conductor 202*b*. The wiring conductors 203 each are formed by removing an unnecessary portion from the aluminum film by etching utilizing photolithography to form a predetermined pattern so that it has one end connected to the corresponding anode conductor 202 and the other end formed with a terminal connection 204.

The substrate 201 is formed on the portion thereof except the anode conductors 202 with a colored insulating layer 205. The insulating layer 205 is colored black so as to reduce reflection of external light. A phosphor layer 206 is deposited on each of the mesh-like anode conductors 202*b* and the periphery thereof. Such deposition may be carried out in a manner to extend a part of the phosphor layer 206 to the frame-like anode conductor 202*a*, as shown in FIG. 5.

Nevertheless, even the fluorescent display device shown in FIGS. 4 and 5 which is constructed in the manner as described above still has a disadvantage that the frame-like anode conductors 202*a*, wiring conductors 203, terminal connections 204 and the like are observed as a specular surface as shown in FIG. 4 when luminous display is viewed through the substrate 201. Further, the fluorescent display device has another disadvantage that the manufacturing process and construction are complicated due to use of the insulating layer 205. A further problem of the fluorescent display device is that there are encountered deformation of the substrate, consumption of the aluminum film and the like due to the calcination of the insulating layer 205 at a high temperature.

SUMMARY OF THE INVENTION

The present invention has been made in view of the foregoing disadvantages of the prior art.

It is an object of the present invention to provide a fluorescent display device which is capable of substantially reducing reflectance of wiring conductors and anode conductors to facilitate reading of display segments, to thereby exhibit excellent visibility.

In accordance with the present invention, there is provided a fluroescent display device which comprises a light-permeable insulating substrate, a colored antireflection film arranged on the insulating substrate, wiring conductors and light-permeable anode conductors arranged on the antireflection film. The wiring conductors and anode conductors are formed of a metallic film and a phosphor layer deposited on each of the anode conductors which is adapted to emit light upon impingement of electrons emitted from a filamentary cathode thereon. Light emitted from the phosphor layer is observed from the other surface of the light-permeable insulating substrate through the anode conductor the antireflection film, and the substrate.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, wherein.

DETAILED DESCRIPTION OF THE PREFERRED EMBODIMENT

A fluorescent display device according to the present invention will be described hereinafter with reference to FIGS. 6 to 11.

Figure 6:
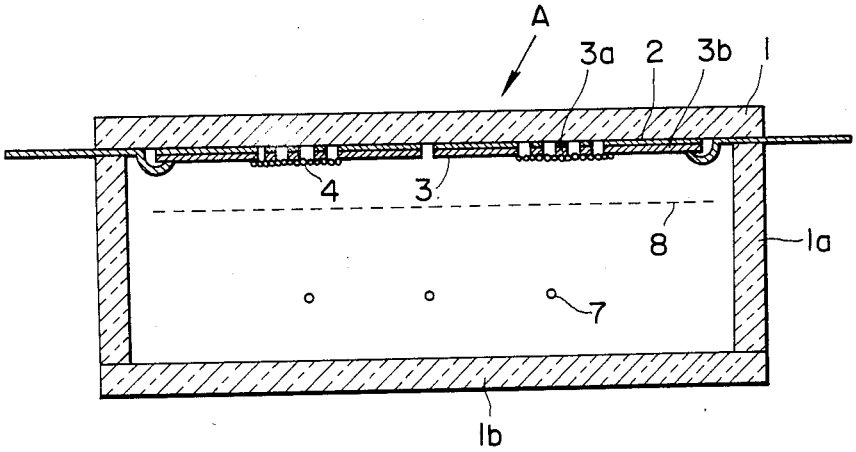
FIG. 6 is a vertical sectional view showing one embodiment of a fluorescent display device according to the present invention.

A fluorescent display device shown in FIG. 6 includes an anode substrate A which comprises a light-permeable insulating substrate 1, an antireflection film 2, anode conductors 3*a*, phosphor layers 4 and wiring conductors 3*b*. The words "light-permeable" of the light-permeable insulating substrate are used to include both "transparent" and "translucent". More particularly, supposing that the light-permeable substrate 1 is formed of a glass material, transparent glass, translucent glass and the like are used as a material for the light-permeable substrate 1.

The antireflection film 2 is arranged on one surface of the light-permeable insulating substrate (hereinafter abbreviated to "substrate") 1. The antireflection film 2 is deposited on the substrate 1 as a thin film by a suitable process such as vacuum deposition, sputtering or the like. A material used for forming the antireflection film 2 is generally classified into groups. One of them is a material with low reflectance. It may be light-impermeable material. For example, chromium oxide, manganese oxide or the like is used for this purpose. A chromium oxide film is colored black and obtained by subjecting metallic chromium to reactive vacuum deposition. A manganese oxide film is obtained by reactive vacuum deposition of metallic chromium or vacuum deposition of a MnO tablet. Such material of low reflectance further includes metal oxides such as $Fe_2O_3$, $NiO_2$, $PtO_3$, PdO, $SnO_2$, $Ta_2O_5$ and the like.

The other material for the antireflection film 2 is a colored light-permeable material. The colored light-permeable material includes $MoO_2$ or $WO_2$ each of which is subjected to vacuum deposition to form a light-permeable antireflection film of blue color, $Sb_2S_3$ forming a film of red color, $Tl_2S$ forming a film of red black color and the like. These materials may be deposited on the substrate by vacuum deposition, sputtering or the like. The colored light-permeable material further includes $TiO_3$ forming its lower oxide of blue color by vacuum deposition, $Nb_2O_5$ forming its lower oxide film of blue black color by vacuum deposition, $Eu_2O_3$, $ErO_3$ and PbO each forming a deposited film of red color and the like.

The antireflection film 2 is formed by depositing one of the materials described above under vacuum.

The antireflection film 2 thus formed has a metallic film 3 arranged thereon by which the anode conductors 3*a* and wiring conductors 3*b* are formed. Metal suitable for use for forming the anode conductor 3*a* and wiring conductor 3*b* is not limited to a specific one as long as it is electrically conductive and capable of forming a thin film by a suitable means such as vacuum deposition, sputtering or the like. The metal includes, for example, Al, Au, Ag, Cu, Ni, Cr and the like. In the embodiment, the metallic film 3 is formed of Al by vacuum deposition.

Then, a multi-layer film comprising the antireflection film 2 and metallic film 3 is subjected to a patterning process by etching utilizing photolithography to form the anode conductors 3*a* and wiring conductors 3*b*. The patterning process may be carried out by etching both the antireflection film 2 and metallic film 3 together at a time with a single etching solution or by separately etching the films 2 and 3 using two kinds of etching solutions selected in view of the material of each of the films 2 and 3. The plane configuration of the patterning is substantially the same as that in the conventional fluorescent display device.

Figure 7:
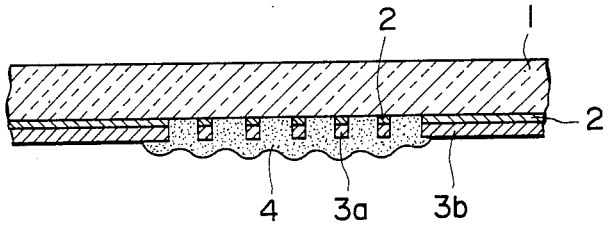
FIGS. 7 to 9 each are an enlarged vertical sectional view showing an anode substrate in a fluorescent display device according to the present invention.
Figure 8:
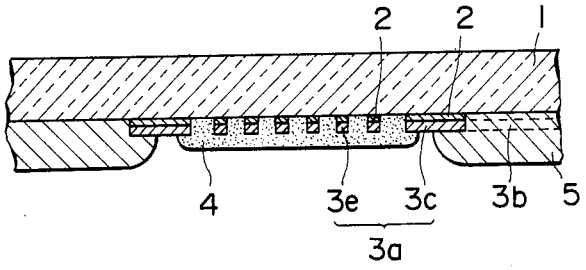
Figure 9:
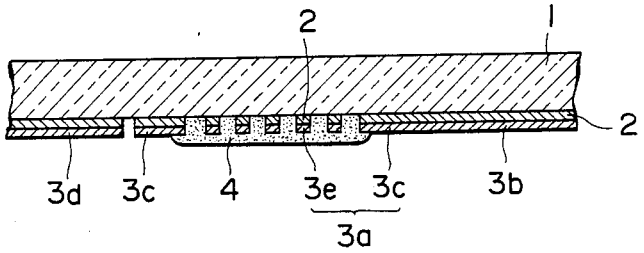

The vertical section of the anode conductor 3*a* of each display segment may be formed to have such a construction as shown in any one of FIGS. 7 to 9.

Figure 1:
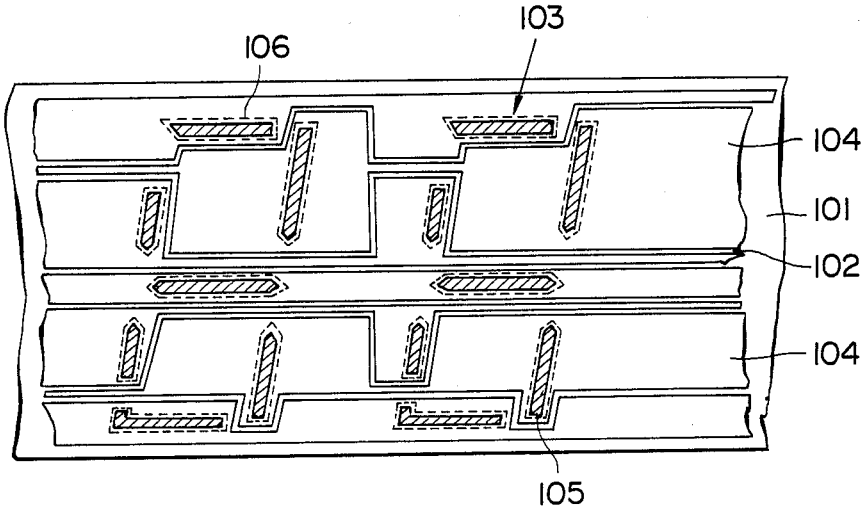
FIG.1 (PRIOR ART)
FIG. 1 is a plan view showing a part of an anode substrate of a conventional fluorescent display device.
Figure 2:
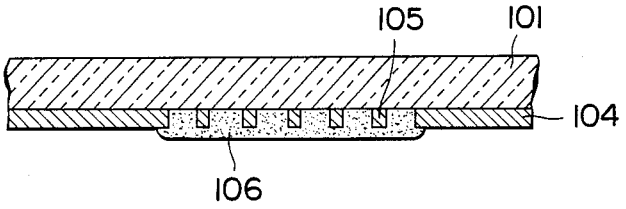
FIG.2 (PRIOR ART)
FIG. 2 is a fragmentary enlarged sectional view of the anode substrate shown in FIG. 1.

In FIG. 7, the plane configuration of the patterning is the same as that shown in FIG. 1. An anode conductor 3*a* of each display segment is formed into a mesh or slit-like shape and arranged on one surface of a substrate 1 through an antireflection film 2. A wiring conductors 3*b* is also arranged through the antireflection film 3 on the substrate 1.

Then, a phosphor layer 4 is deposited on each of the anode conductors 3*a* and a region adjacent thereto.

Figure 4:
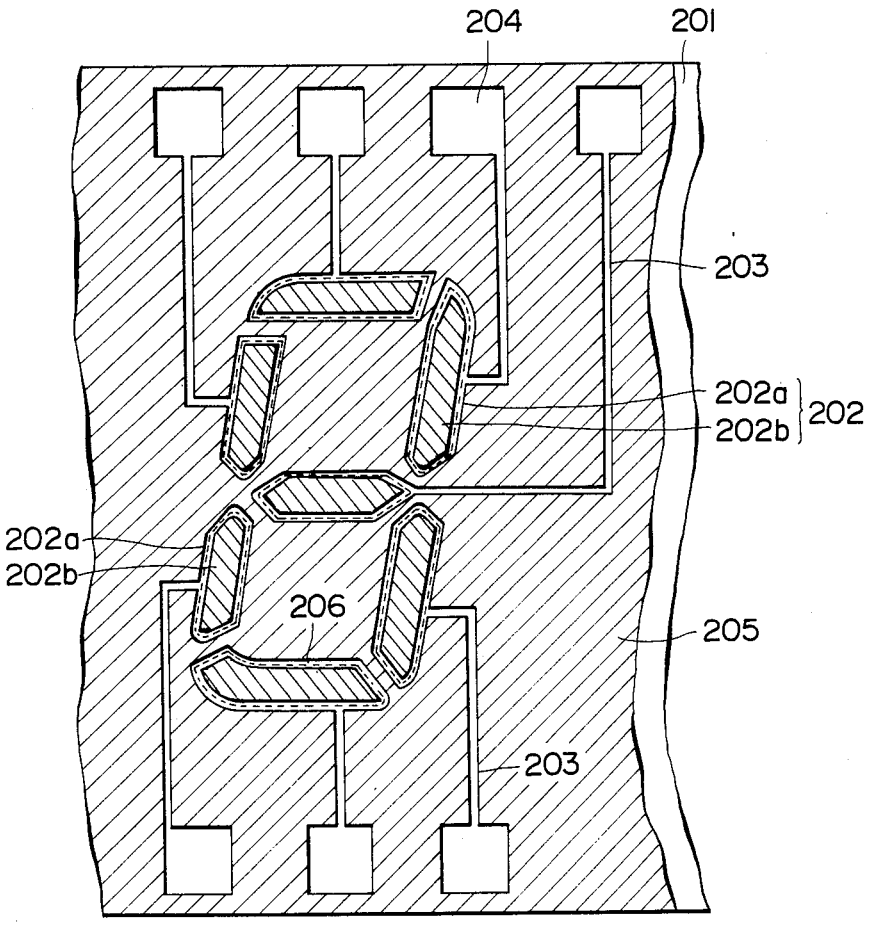
FIG. 4 is a plan view showing a part of an anode substrate of a further conventional fluorescent display device.
Figure 5:
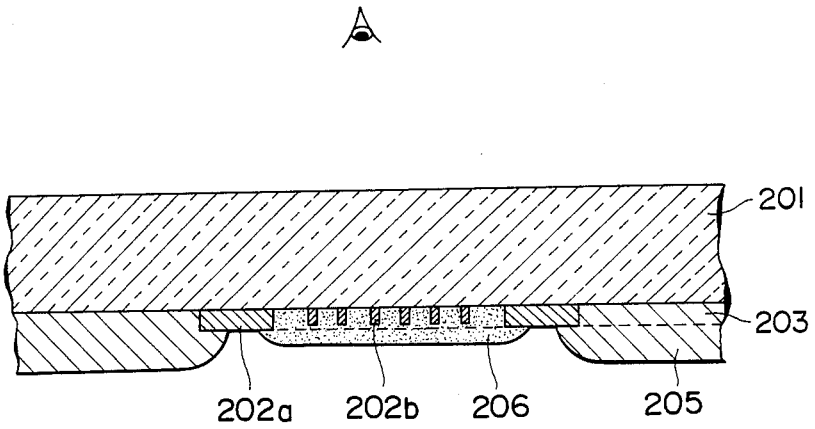
FIG.5 (PRIOR ART)
FIG. 5 is a fragmentary enlarged sectional view of the anode substrate shown in FIG. 4.

In FIG. 8, the plane configuration of the patterning is substantially the same as that in FIG. 4. In FIG. 8, an anode conductors 3*a* of each display segment comprises a mesh-like anode conductor 3*e* and a frame-like anode conductor 3*c* arranged to surround the mesh-like anode conductor 3*e*. The anode conductors 3*a* and wiring conductors 3*b* are arranged through an antireflection film 2 on a substrate 1. Reference numeral 5 designates a colored insulating layer which is arranged to cover a part of the frame-like anode conductor 3*c* but not to cover the mesh-like anode conductor 3*e*.

Then, a phosphor layer 4 is deposited on the mesh portion of the mesh-like anode conductor 3*e* and the anode conductor 3*a*. The deposition of the phosphor layer 4 can be carried out without high accuracy, because even when the phosphor layer 4 is deposited on a part of the frame-like anode conductor 3*b*, the portion of the phosphor layer is not observed. Thus, this does not cause the display quality to be deteriorated.

Figure 3:
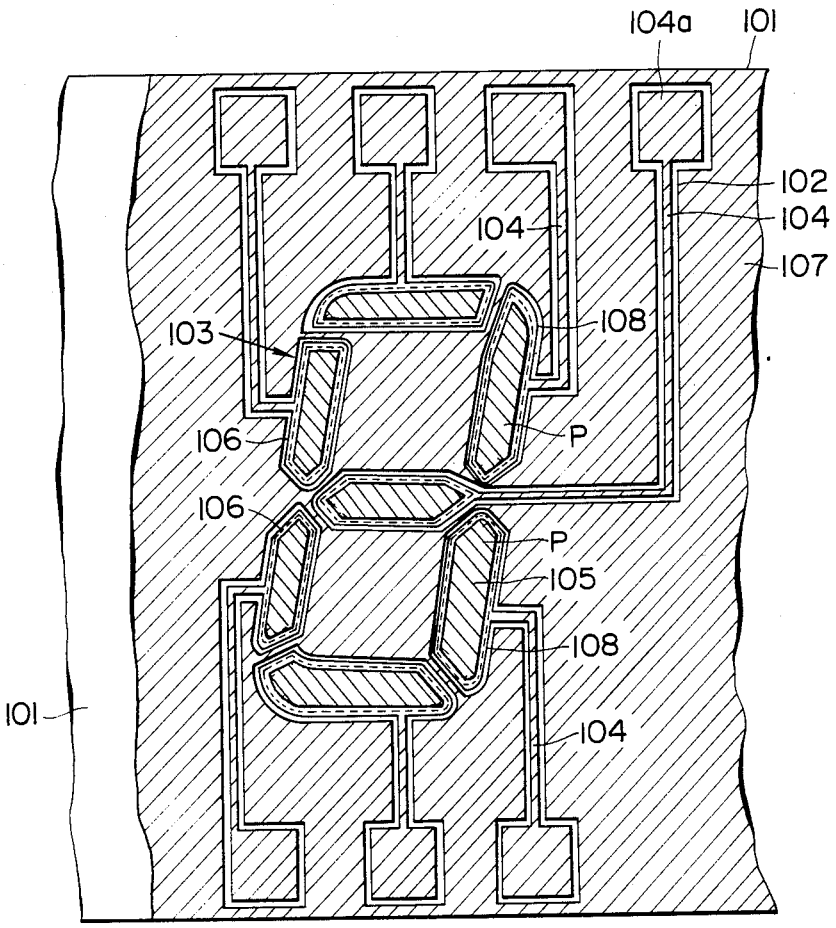
FIG.3 (PRIOR ART)
FIG. 3 is a plan view showing a part of an anode substrate of another conventional fluorescent display device.

In FIG. 9, the plane configuration of the patterning is substantially the same as that in FIG. 3, wherein a static driving system utilizing an auxiliary electrode is employed.

In a fluorescent display device shown in FIG. 9, an antireflection film 2 is arranged on a substrate 1, and an anode conductor 3*a*, a wiring conductor 3*b* and an auxiliary electrode 3*d* each formed of the metallic film are arranged on the antireflection film 2. The anode conductor 3*a* is formed into a mesh-like shape and a frame-like anode conductor 3*c* is provided a the periphery of each display segment. The wiring conductor 3*b* is electrically connected with the frame-like anode conductor 3*c*. The auxiliary electrode 3*d* is arranged so as to be electrically isolated from the anode conductor 3*a*. Subsequently,a phosphor layer 4 is deposited on the anode conductor 3*a* to cover the mesh-like anode conductor 3*e* and a part of the frame-like anode conductor 3*c*. A control electrode 8 and a filamentary cathode 7 are arranged above the anode substrate constructed as described above as desired. Further, a casing comprising side plates 1*a* and a front cover 1*b* is hermetically sealed on the substrate through external terminals to form an envelope and the casing is evacuated to vacuum.

Figure 10:
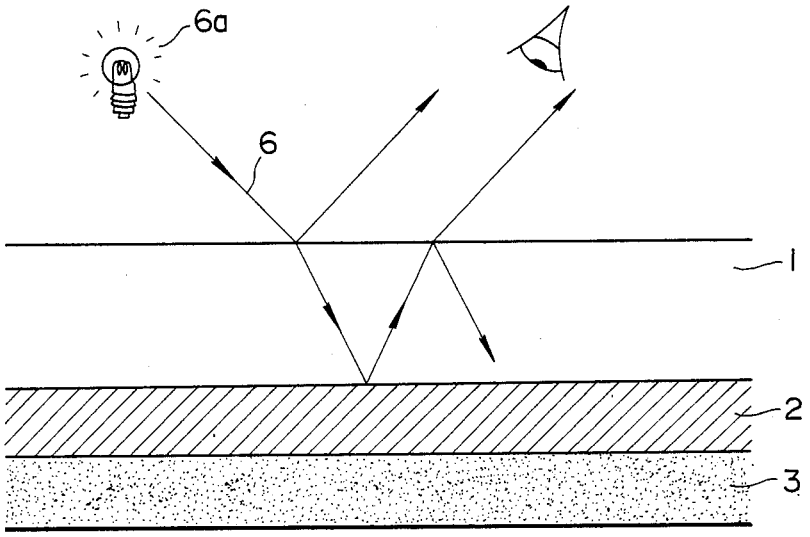
FIGS. 10 and 11 each are a schematic view showing refraction of external light in a fluorescent display device according to the present invention.

The fluorescent display device according to the present invention, as described above, is constructed in the manner to arrange the anode conductors 3*a* and wiring conductors 3*b* each formed of the metallic film 3 on the substrate 1 through the antireflection film 2. Thus, when viewing through the substrate 1, the metallic film 3 forming a specular surface is not observed and external light 6 is refracted in such a manner as shown in FIG. 10 or 11 depending upon the material of the antireflection film 2 to reach an observer.

Figure 11:
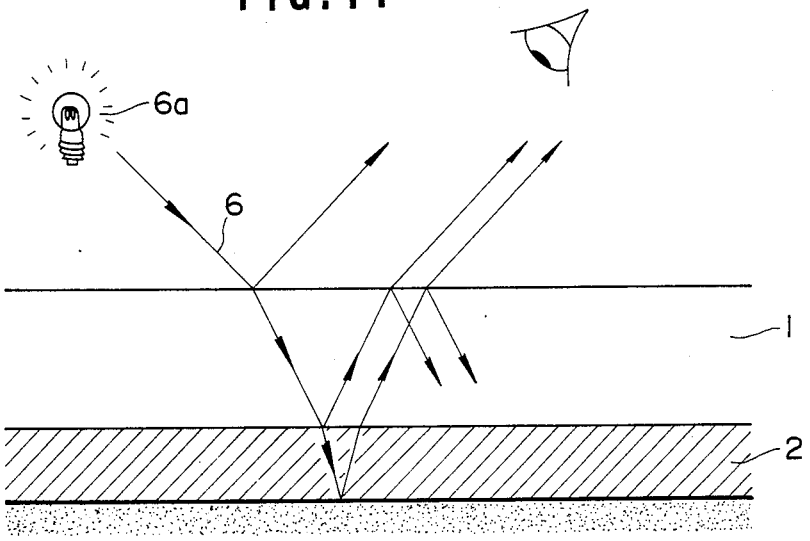

In FIG. 11, the antireflection film 2 is formed of a material of low reflectance. The material of low reflectance is non-transparent and impermeable. Thus, external light 6 emitted from a light source 6 is partially refracted by the surface of the glass substrate 1, and the remaining light penetrates into the substrate 1 and is refracted by the surface of the antireflection film 2. However, the antireflection film 2 is made of a material having low reflectance, resulting in specular reflection being substantially reduced. Light subjected to specular reflection, when it is to be outward discharged through the glass substrate 1, is partially refracted by the surface or interface of the substrate 1 so that a part of the light enters the substrate 1 again. Thus, it will be noted that in FIG. 10, the specular reflection of external light is substantially reduced due to refraction causing diffusion of the light and absorption.

In FIG. 11, the antireflection film 2 is formed of a light-permeable material having low permeability.

Light, for example, emitted from a light source 6a penetrates the substrate 1 and is partially reflected by the antireflection film 2. The remaining light enters the antireflection film 2 and then is reflected at the interface between the antireflection film 2 and the metallic film 3 to be outward discharged through the antireflection film 2 and glass substrate 1. At this time, a part of the light is reflected by the surface of the glass substrate 1 to enter the substrate again. Thus, it will be noted that external light is repeatedly absorbed by the glass substrate 11 and antireflection film 2 to reduce the specular reflectance.

Combination of the substrate, antireflection film (material of low reflectance, chromium oxide) and A1 film, and combination of the substrate, antireflection film (light-permeable material, molybdenum oxide) and A1 film in the present invention were compared with combination of only a substrate and an A1 film in the conventional fluorescent display device. In this test, used wavelength was 550 nm and the difference between total reflectance and diffused reflectance (total reflectance—diffused reflectance) in a spectrophotometer was defined to be specular reflectance.

The specular reflectance was 79.5% in the conventional combination, 5.9% in the combination using the antireflection film of chromium oxide in the present invention and 6.0% in the combination using the antireflection film of molybdenum oxide film in the present invention. Thus, it will be noted that the specular reflectance in the present invention is less than 10% which is sufficient to substantially reduce the specular surface. Accordingly, the fluorescent display device of the present invention allows reading of the display segment to be facilitated and reduces the misreading. Particularly, the present invention significantly improves visibility in the reading under high illuminance.

Further, in the fluorescent display device of the present invention, the wiring conductors and terminals are arranged through the antireflection film or layer. Such arrangement allows the elements other than the display segment to be colored, for example, black, resulting in all the display surface having low reflectance to improve visibility and design.

While preferred embodiment of the present invention has been described with a certain degree of particularity, obvious modifications and variations are possible in light of the above teachings. It is therefore to be understood that within the scope of the appended claims, the invention may be practiced otherwise than as specifically described.

What is claimed as new and desired to be secured by Letters Patent of the United States is:

1. A fluorescent display device comprising:

a light-permeable insulating substrate;

a colored antireflection thin film arranged on said light-permeable insulating substrate;

wiring conductors and light-permeable anode conductors arranged in first and second areas respectively on said antireflection film, said wiring conductors and anode conductors being formed of a metallic film;

said colored antireflection thin film and said light-permeable anode conductors being divided into a number of fragments for delineating display indicia and formed into similar patterns on said insulating substrate so that said thin film overlies all of said anode conductors and occurs nowhere else in said second area and so that portions of said substrate are left exposed in said second area; and a phosphor layer deposited on each of said anode conductors in said exposed portions of said substrate which phosphor layer is adapted to emit light upon impingement of electrons emitted from a filamentary cathode thereon; thereby light emitted from said phosphor layer being observed from the other surface of said light-permeable insulating substrate through said substrate; and said color antireflection thin film acting to reduce the specular reflection of external light from said anode conductors and said wiring conductors.

2. A fluorescent display device as defined in claim 1, wherein said antireflection film is formed of a light-impermeable material with low reflectance.

3. A fluorescent display device as defined in claim 1, wherein said antireflection film is formed of a light-permeable material with low permeability.

4. A fluorescent display device as defined in claim 2, wherein said antireflection film is formed of metal oxides selected from the group consisting essentially of CrO, MnO, $Fe_2O_3$, $NiO_2$, $PtO_3$, PdO, $SnO_2$ and $Ta_2O_5$.

5. A fluorescent display device as defined in claim 3, wherein said antireflection film is formed of metal oxides selected from the group consisting essentially of $MoO_2$, $WO_2$, $TiO_3$, $Nb_2O_5$, $Eu_2O_3$, $ErO_3$ and PbO.

6. A fluorescent display device as defined in claim 3, wherein said antireflection film is formed of $Sb_2S_3$.

7. A fluorescent display device as defined in claim 3, wherein said antireflection film is formed of $Tl_2S$.

* * * * *